United States Patent [19]

Ishigaki et al.

[11] 4,207,735

[45] Jun. 17, 1980

[54] DIAL AND MOVEMENT FIXING STRUCTURE

[75] Inventors: Hisao Ishigaki, Tokyo; Ryuzo Tanaka, Tanashi, both of Japan

[73] Assignee: Citizen Watch Co. Ltd., Tokyo, Japan

[21] Appl. No.: 942,328

[22] Filed: Sep. 14, 1978

[30] Foreign Application Priority Data

Sep. 19, 1977 [JP] Japan ..... 52-126064[U]

[51] Int. Cl.[2] ..... G04B 37/00; G04B 37/04; G04B 19/06

[52] U.S. Cl. ..... 368/300; 368/236; 368/299

[58] Field of Search ..... 58/5, 53, 59, 88 R, 58/88 C, 90 R, 91, 92–94, 104, 125 R, 126 R, 126 A, 126 E, 127 R, 127 B

[56] References Cited

U.S. PATENT DOCUMENTS

| | | | |
|---|---|---|---|
| 2,060,118 | 11/1936 | Putnam | 58/127 B |
| 3,668,865 | 6/1972 | Hirabayashi | 58/127 B |
| 4,110,970 | 9/1978 | Funazana et al. | 58/90 R |

*Primary Examiner*—Vit W. Miska

*Attorney, Agent, or Firm*—Sherman & Shalloway

[57] ABSTRACT

A dial and movement fixing structure comprising a ring having legs that are held between a case ring of a watch case and a back cover, and a dial attached to the ring, wherein projections formed on the ring are introduced into a plurality of notched portions formed in the periphery of the dial such that the dial is fixed to the ring.

5 Claims, 10 Drawing Figures

DIAL AND MOVEMENT FIXING STRUCTURE

BACKGROUND OF THE INVENTION

1. Field of the Invention

The present invention relates to a structure for fixing a dial and a movement to a watch case maintaining a predetermined relation.

2. Description of the Prior Art

A dial-fixing structure disclosed in U.S. Pat. No. 3,668,865 uses an annular member having flange sections for holding the dial and a flange for fastening the movement. The annular member is held between a ring of the watch case and a back cover so as to be held at a predetermined position of the watch case thereby to secure the dial and the movement to the watch case. According to this structure, the dial which is engaged at its peripheral portion with the flange sections of the annular member, is allowed to be easily mounted on the annular member. For attaining this arrangement, the flange sections must have an upwardly extending portion which extends upwardly through the outer side of the periphery of the dial, and a portion which extends toward the inner side from the upper end of the upwardly extending portion. Therefore, there are present wide portions that are not utilized for display betweent the inner surface of the watch case and the practically used portions of the dial. These useless portions give a disadvantage that the watch appears to be smaller than the actual size of the watch, and further present great limitation in designing the watch.

SUMMARY OF THE INVENTION

The principal object of the present invention is to provide a dial- and movement-fixing structure which is capable of reducing the useless areas between the inner diameter of the watch case and the diameter (effective diameter) of the practically visible portions of the dial, as compared to the conventional counterparts.

To attain the abovementioned object, the present invention uses a ring having engaging means for mounting the movement and further having a plurality of projections on its upper surface. The projections of the ring are introduced into a plurality of notched portions formed in the dial which is placed above the ring. The individual notched portion preferably consists of a pair of arcuate portions that are so arrayed as to face each other along a direction in parallel with the circumference of the dial, and a straight portion for connecting the ends of the two arcuate portions. Like the notched portions, the projections that will be introduced into the notched portions exhibit the form of an oval plane having two arcuate portions and a pair of straight portions to connect the arcuate portions. Here, the projections have a length slightly greater than the length of the notched portions, and a width slightly smaller than the width of the notched portions. Accordingly, when forcibly introduced into the corresponding notched portions, the individual projections are principally compressed in the lengthwise direction in regard to its cross section, wherein the restoring force words as a bonding force to fix the dial to the ring. Further, a gap between the straight portion of the notched portion and the projection permits the projection which is compressed and deformed in the lengthwise direction to be swollen in the lateral direction.

That is, according to the present invention, the bonding between the dial and the ring is attained at the portions close to their outer edge, whereby the ring needs not have portions that are located on the outer side of the outer edge of the dial. This enables the surface of the dial to be effectively utilized for the purpose of display.

DETAILED DESCRIPTION OF PREFERRED EMBODIMENTS

Figure 1:
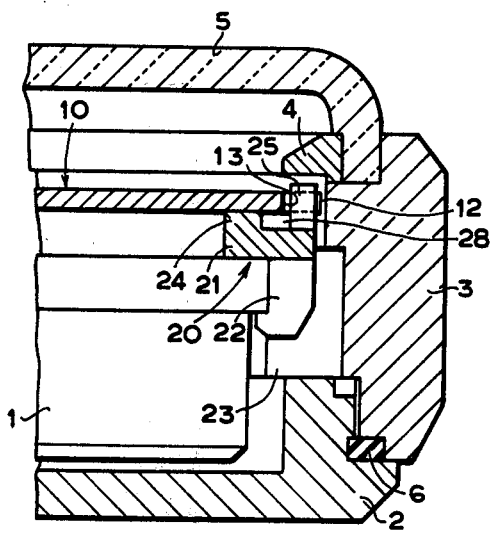
FIG. 1 is a vertical cross-sectional view showing a portion of a watch equipped with a dial- and movement-fixing structure according to the present invention.

Illustrating with reference to the drawings, the watch case in FIG. 1 is composed of a case ring 3, a back cover 2 attached to the case ring by an attaching means such as screw, and a cover glass 5 fitted to the case ring via a tension ring 4. Preferably, a packing 6 is provided between the case ring 3 and the back cover 2 for the purpose of sealing.

Figure 2:
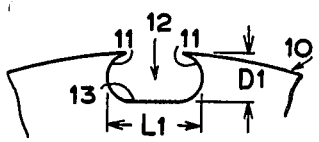
FIG. 2 is a plan view showing a portion of a dial used for the watch of FIG. 1.

The assembly accomodated in the watch case consists of a movement 1, a dial 10 and a ring 20. The ring 20 has an annular portion 21 and legs 23 extending downwardly from the annular portion 21. The legs 23 have an outer edge stretching beyond the outer side of the outer edge of the annular portion 21. The legs 23 are sandwiched between the case ring 3 and the back cover 2 and are held at a predetermined position in the watch case. The ring 20 has a portion 22 which downwardly stretches beyond the lower surface of the annular portion 21, and the lower end of the portion 22 forms a hook that engages with a stepped portion formed on the circumference of the movement 1, so that the movement 1 is fastened to the ring 20. The ring 20 further possesses a support portion 24 of which upper surface comes into contact with the lower surface of the dial 10, and a plurality of projections 25 of which upper ends are located above the upper surface of the support portion 24. The individual projections 25 are introduced into a plurality of notched portions 12 formed along the outer edge of the dial 10. As shown in FIG. 2, the notched portions 12 have a pair of arcuate portions 11 that are opposed to each other, and a connection portion 13 connected to the ends of the two arcuate portions, thereby forming an oval shape which is open at its one portion to the outer side. Here, the longer diameter of the oval shape is denoted by $L_1$ and the shorter diameter by $D_1$.

Figure 4:
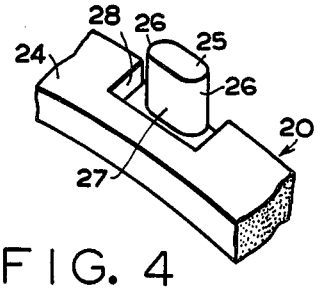
FIG. 4 is a perspective view showing a portion of the ring of FIG. 3.
Figure 3:
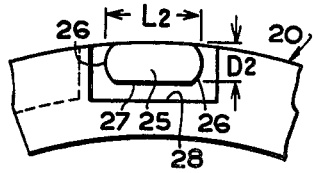
FIG. 3 is a plan view showing a portion of a ring.
Figure 5:
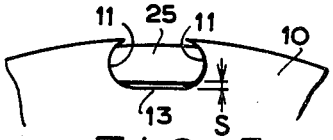
FIG. 5 is a plan view showing a portion of the combination of the dial and the ring.
Figure 6:
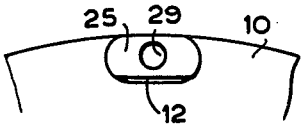
FIGS. 6 to 10 are plan views showing a portion of the dial- and movement-fixing structure according to other embodiments of the present invention.

As shown in FIGS. 3 and 4, the projections 25 formed on the ring 20 have an oval plane shape consisting of a pair of arcuate portions 26, the longer diameter $L_2$ thereof being slightly greater than the longer diameter $L_1$ of the notched portion, and the shorter diameter $D_2$ thereof being slightly smaller than the shorter diameter $D_1$ of the notched portion. Therefore, as shown in FIG. 5, when the projections 25 are forcibly inserted in the notched portions 12, the arcuate portions 26 are compressed to the corresponding arcuate portions 11, whereby a gap of a width S is formed between one side surface 27 of the projections 25 and the connecting portion 13. Such a forcible insertion of the projections 25 into the notched portions 12 will be easily attained when the ring 20 is made of a material having suitable flexibility or resiliency, such as a synthetic resin like polyethylene or ABS resin. Since the longer diameter $L_2$ of the projections 25 is slightly greater than the longer diameter $L_1$ of the notched portions 11, the projections 25 when introduced into the notched portions 11 are compressed in the lengthwise direction so that the shorter diameter is swollen. The gap S between the projections 25 and the connecting portion 13 of the notches 12 absorbs the increase of the projections 25 swollen in the direction of their shorter diameter. Therefore, the projections can be smoothly introduced into the notches 12 creating suitable resistance, whereby the dial 10 which is moved to a position at which it comes into contact with a support surface of the support portion 24 is reliably maintained at that position. A groove 28 formed along the periphery of a base portion of the projections 25 facilitates the insertion of the projections into the notched portions until the dial 10 comes into intimate contact with the upper surface of the support portion 24. Moreover, if a hole 29 is provided in the projections 25 extending from the upper surface thereof toward the lower side as shown in FIG. 6, the abovementioned deformation of the projections 25 will take place further easily.

Figure 7:
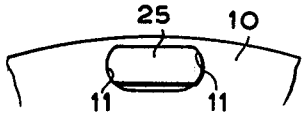
Figure 8:
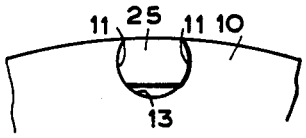

From the viewpoint of most effectively utilizing the surface of the dial 10 as an effective display surface, it is recommended that the notched portions 12 are provided at the portions nearest to the outer edge of the dial 10, and the edges on the inner side of the notched portions 12 are in parallel with the outer edge of the dial. However, when there is some extra space on the surface areas of the dial 10, it will be allowed to provide the notched portions 12 at the positions slightly deviated toward the inner side from the outer edge of the dial. According to a preferred embodiment of the present invention shown in FIG. 7, the notched portions 12 are forming holes that are not communicated to the outer side. Further, referring to an embodiment shown in FIG. 8, the notched portions 12 are formed at the positions closest to the outer edge of the dial 10. In this case, the inner edge, i.e., the connecting portion 13 is stretching on the same circumference as that of the two arcuate portions 11.

Figure 9:
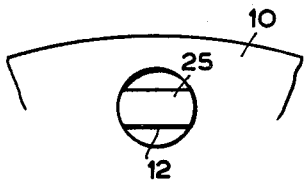
Figure 10:
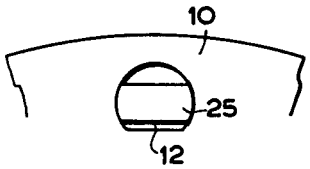

According to an embodiment shown in FIG. 9, the circular notched portions 12 are provided at positions located on an inner side separated away from the outer edge of the dial 10. Further, referring to an embodiment shown in FIG. 10, the portion of the notched portions 12 located on the inner side of the projections 25 is stretching in parallel with the inner side surface of the projections.

The embodiments shown in FIGS. 6 to 10 are common to the embodiment shown in FIGS. 1 to 5 in regard to that the notched portions 12 possess a pair of arcuate portions 11 that are faced to each other, and that the distance between the arcuate portions 11 is slightly smaller than the distance between the pair of arcuate portions 26 of the projections 25 that will be introduced into the notched portions 12.

According to the movement- and dial-fixing structure of the present invention mentioned in the foregoing, the dial 10 is fastened to the ring 20 owing to the resilient contact between the inner surfaces of two arcuate portions 11 of the notched portions 12 formed in the dial and the two arculate portions 26 of the projections 25 formed on the ring 20 introduced into the notched portions. Such a resilient contact gives a sufficient friction for reliably fastening the dial 10 to the ring 20. In other words, in order to fasten the dial 10 to the ring 20, the ring 20 simply needs to possess a plurality of projections 25 stretching straight; the projections need not have engaging surfaces that may stretch inwardly at the upper portion of the dial. It is, therefore, allowed to provide a dial having an area nearly equal to the opening surface of the watch case, as well as to effectively use the surface on the dial, thereby contributing to increase the degree of feedom particularly in designing the display surfaces of the timepieces.

What is claimed is:

1. A dial- and movement-fixing structure having a ring for fixing a dial and a movement at predetermined positions in a watch case, wherein:

(a) said dial possesses notched portions composed of a pair of arcuate portions that are faced to each other in a direction in parallel with the outer edge of said dial;

(b) said ring is of a unitary structure made of a synthetic resin having: a plurality of projections on the upper surface at positions corresponding to each of the notched portions formed in said dial, a plurality of leg portions on the lower surface to engage with said movement, and legs that will be sandwiched between of said watch case and a back cover such that said ring is fixed at a predetermined position in said watch case;

(c) each of said projections possesses plural arcuate portions corresponding to the arcuate portions of said notched portions, and side surfaces that are connected to the inner ends of said arcuate portions and that do not come into contact with the inner surfaces of said notched portions, the distance between the arcuate portions of said projections being slightly greater than the distance between the arcuate portions of said notched portions; and (d) the upper surface of said ring having a groove along a base portion of said projection facilitating the insertion of the projections into the notched portions.

2. A fixing structure according to claim 1, wherein said notched portions are of a circular plane shape, portions on the inner surface thereof defining said arcuate portions.

3. A fixing structure according to claim 1, wherein said notched portions are communicated at its one portion to the outer side of said dial.

4. A fixing structure according to claim 1, wherein said projections have a hole stretching from the upper surface thereof toward to lower direction.

5. A fixing structure according to claim 1, wherein the inner surfaces of said projections are stretching nearly in parallel with the outer edge of said dial.

* * * * *